US006586869B1

(12) United States Patent
Park et al.

(10) Patent No.: US 6,586,869 B1
(45) Date of Patent: Jul. 1, 2003

(54) ELECTRODES OF ELECTRON GUN

(75) Inventors: In-gyu Park, Suwon (KR); Young-kon Hong, Suwon (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 274 days.

(21) Appl. No.: 09/714,967

(22) Filed: Nov. 20, 2000

(30) Foreign Application Priority Data

Nov. 19, 1999 (KR) ..... 99-51493

(51) Int. Cl.[7] ..... H01J 29/50

(52) U.S. Cl. ..... 313/414; 313/409; 313/426; 313/427; 313/428

(58) Field of Search ..... 313/414, 426, 313/427, 428, 421, 441, 409, 411, 412; 315/14

(56) References Cited

U.S. PATENT DOCUMENTS 4,766,344 A 8/1988 Say
5,744,903 A * 4/1998 Van Der Poel et al. ..... 313/414
6,013,976 A 1/2000 Gorski et al.
6,081,068 A 6/2000 Sudo et al.
6,133,684 A 10/2000 Kawaharada
6,265,819 B1 * 7/2001 Satou et al. ..... 313/417
6,417,610 B1 * 7/2002 Sudo et al. ..... 313/412

* cited by examiner

*Primary Examiner*—Robert H. Kim
*Assistant Examiner*—Elizabeth Gemmell
(74) *Attorney, Agent, or Firm*—Robert E. Bushnell, Esq.

(57) ABSTRACT

Electrodes of an electron gun including a pair of first and second outer rim electrode members installed to face one another and where large diameter electron beam apertures through which three electron beams pass are respectively formed, and first and second inner electrode member installed in the outer rim electrode members, respectively, and where three small diameter electron beam apertures are formed to have an in-line shape. In the above electrodes, a burring portion is formed at the edge of the large diameter electron beam aperture of the first outer rim electrode member at one side of the outer rim electrode members facing each other, and the vertical diameter of the electron beam aperture formed in the middle of the small diameter electron beam apertures formed at the first inner electrode is formed to be greater than those of the two other small diameter electron beam apertures.

18 Claims, 2 Drawing Sheets

ELECTRODES OF ELECTRON GUN

CLAIM OF PRIORITY

This application makes reference to, incorporates the same herein, and claims all benefits accruing under 35 U.S.C §119 from an application entitled Electrodes Of Electron Gun earlier filed in the Korean Industrial Property Office on Nov. 19, 1999, and there duly assigned Serial No. 99-51493 by that Office.

BACKGROUND OF THE INVENTION

1. Field of the Invention

The present invention relates to a cathode ray tube (CRT), and more particularly, to electrodes for forming an electron lens having a large diameter, and an electron gun for a CRT using the electrodes.

2. Description of the Related Art

In general, a CRT has a panel, or screen, where a fluorescent film is formed, and a funnel coupled to the panel forming a seal. An electron gun is sealed inside a neck portion of the funnel, and a deflection yoke is installed at a cone portion. Examples of such electron guns are found in the following patents incorporated by reference herein: U.S. Pat. No. 4,766,344 to Donald L. Say entitled In-Line Electron Gun Structure For Color Cathode Ray tube Having Oblong Apertures; U.S. Pat. No. 6,013,976 to Richard M. Gorsky et al. entitled In-Line SB Electron Gun With Large And Deep Main Lens Apertures; U.S. Pat. No. 6,081,068 to Akihito Sudo et al. entitled Color Cathode Ray Tube Having Improved Main Lens Electrodes; and U.S. Pat. No. 6,133,684 to Takahiro Kawaharada entitled Electron Gun With Polygonal Shaped Rim Electrode.

A shadow mask frame assembly having a color selection function is installed inside the panel such that an electron beam emitted from the electron gun accurately lands on the fluorescent film. Inner and outer conductive films are formed at the inner and outer circumferential surfaces of the funnel, respectively.

In the CRT having the above structure, the electron beam emitted from the electron gun is selectively deflected by the deflection yoke, and lands on the fluorescent film after passing through electron beam apertures having a color selection function, so that an image is formed.

In the CRT operating as above, a focus feature of having the electron beam emitted from the electron gun installed at the neck portion accurately land on the fluorescent film, and the size of a spot of the electron beam landing on the fluorescent film, are greatly affected by a lens formed by the electrode of the electron gun, particularly by a main lens. Thus, to obtain a superior focus feature, the diameter of the main lens should be as great as possible.

In an in-line type electron gun, three electron beam apertures are formed to have an in-line shape at at least two electrodes forming an electron lens, and the diameter of the neck portion of the funnel where the electron gun is installed is limited. Thus, making the diameter of each of the electron beam apertures greater than the distance between the centers of the two electron beam apertures adjacent to each other, is not possible.

To solve the above problem, an electron beam aperture having a large diameter, through which three electron beams passes in common, is contemplated, an example of which is shown in FIG. 1.

As shown in FIG. 1, the electrode of the electron gun forming an electron lens includes focusing electrodes 10 and

20 having outer electrode members 13 and 23 and inner electrode members 14 and 24. Here, a large diameter electron beam apertures 11 and 21 through which three electron beams pass are formed at the outer electrode members 13 and 23. Burring portions 12 and 22 are formed along the edge of the large diameter electron beam apertures 11 and 21. Also, the inner electrode members 14 and 24 are installed at the inner surfaces of the outer electrode members 13 and 23, respectively. A pair of three electron beam apertures 14R, 14G and 14B, and 24R, 24G and 24B, each being circular, having a small diameter and arranged in an in-line format, are formed at the inner electrode members 14 and 24, respectively.

In the electron gun having the above exemplary structure, when different voltages are applied to the electrodes, lines of electric force are formed between the electrodes and equipotential lines are formed in a normal direction with respect to the lines of electric force so that an electron lens is formed. The burring portions 12 and 22 formed at the edge of the large diameter electron beam apertures 11 and 21 of the electron lens, respectively, decrease the effective areas of the large diameter electron beam apertures 11 and 21. Thus, there is a limit in decreasing spherical aberration of the electron lens formed by the large diametric electron beam apertures 11 and 21. Further, the beam spot size of the electron beam passing through the large diametric electron beam apertures 11 and 21 increases undesirably. Also, the widths of the edges of the large diametric electron beam apertures 11 and 21 are relatively large due to the burring portions 12 and 22 extending from the edges of the large diametric electron beam apertures 11 and 21 toward the inner side of each of the outer electrode members 13 and 23. Since the electrical field concentrates on the end portions of the burring portions 12 and 22, designing OCV (Outer Beam Convergence Variance) that is the distance between the electron beams to excite a red fluorescent substance and a blue fluorescent substance is difficult. Here, the OCV means the eccentric distance between the electron beams landing on the red fluorescent substance and the blue fluorescent substance. That is, the OCV design of the electron beam is affected by the difference in horizontal length of the large diameter electron beam apertures 11 and 21 and the length of a bulb, and design and process error control thereof are not easy. Also, removal of the burring portions 12 and 22 of large diameter electron beam apertures 11 and 21 formed in outer electrodes 13 and 23 result in leakage current being generated by acute portions formed at the edge of the large diameter electron beam apertures, so that the electron lens is distorted.

SUMMARY OF THE INVENTION

To solve the above problems, it is an objective of the present invention to provide electrodes of an electron gun for a color CRT which can make a large diameter electron lens, minimize the spot size of the electron beam passing the large diameter electron lens, and reduce the generation of leakage current, so that distortion of the electron lens is prevented.

Accordingly, to achieve the above objective, there is provided electrodes of an electron gun including a pair of first and second outer rim electrode members installed to face one another and where large diameter electron beam apertures through which three electron beams pass are respectively formed, and first and second inner electrode member installed in the outer rim electrode members, respectively, and where three small diameter electron beam apertures are formed to have an in-line shape, wherein a burring portion is formed at the edge of the large diameter electron beam aperture of the first outer rim electrode member at one side of the outer rim electrode members facing each other, and the vertical diameter of the electron beam aperture formed in the middle of the small diameter electron beam apertures formed at the first inner electrode is formed to be greater than those of the two other small diameter electron beam apertures.

It is preferable in the present invention that the burring portion is formed at the electrode located adjacent to a cathode when it is installed at the electron gun.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
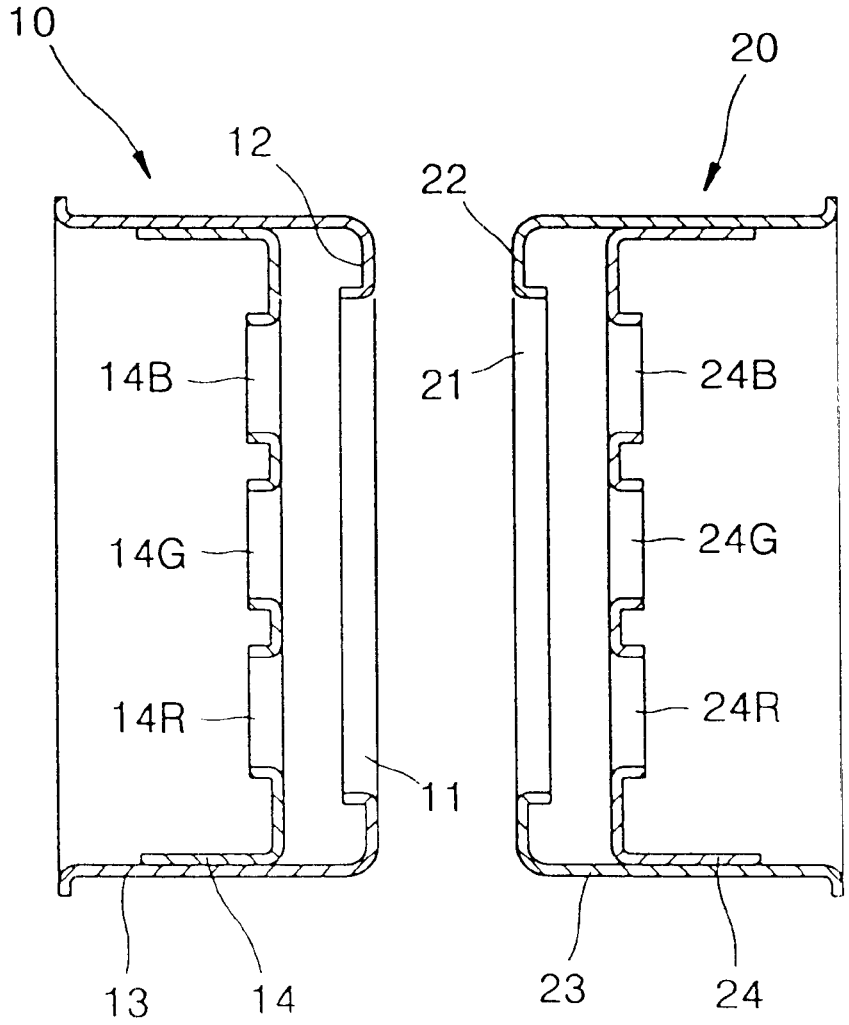
FIG. 1 (PRIOR ART)
FIG. 1 is a sectional view showing the electrodes of a exemplary electron gun for a color CRT.
Figure 2:
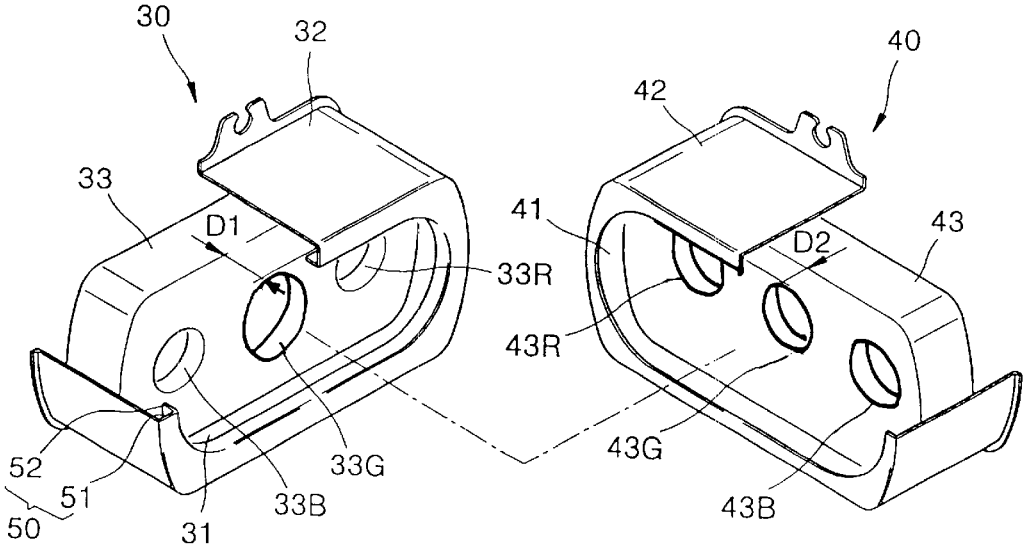
FIG. 2 is a perspective view showing electrodes forming an electron lens of an electron gun according to a preferred embodiment of the present invention.

Referring to FIG. 2, an electron gun for a CRT adopting electrodes according to a preferred embodiment of the present invention includes a cathode (not shown), a control electrode (not shown) and a screen electrode (not shown), which form a triode, and at least a pair of first and second focusing electrodes 30 and 40 for forming an auxiliary and/or main lens.

The first and second focusing electrodes 30 and 40 are installed to face each other as shown in FIG. 2, and include first and second outer rim electrode members 32 and 42 where large diameter electron beam apertures 31 and 41 through which three electron beams pass in common are respectively formed, and first and second inner electrode members 33 and 43 which are installed inside the first and second outer rim electrode members 32 and 42, respectively, and where three small diameter electron beam apertures 33R, 33G and 33B, and 43R, 43G and 43B are respectively formed.

There is a burring portion bent inward formed at the edge of one the large diameter electron beam apertures of one of the first and second outer rim electrode members. Here, a burring portion 50 bent inward is formed at the edge of the large diameter electron beam aperture 31 of one of the outer electrodes 32. The burring portion 50 is preferably formed at the first outer rim electrode member 32 of the first focusing electrode located at the cathode (not shown) of the electron gun. The burring portion 50 is bent toward the center of the outer electrode to form a plane portion 51, and an end portion of the plane portion 51 is bent inward to form a bent portion 52. The burring portion 50 is not limited to the above-described embodiment and a variety of modifications thereof can be possible so long as leakage current is not generated.

A distance D1 between the end portion of the first outer rim electrode member 32 and the first inner electrode member 33 of the first focusing electrode 30 is formed to be equal to or less than the distance D2 between the end portion of the second outer rim electrode member 42 and the second inner electrode member 43 of the second focusing electrode 40.

The three small diameter electron beam apertures formed to be in-line at the first and second inner electrode members 33 and 43 are formed to be circular or non-circular. It is preferable that the small diameter electron beam apertures are formed to have vertically elongated oval shapes. The vertical diameter of the electron beam aperture 33G disposed in the middle of the small diameter electron beam apertures 33B and 33R is formed to be greater than those of the electron beam apertures 33B and 33R. The vertical diameter of the electron beam aperture 33G is formed to be equal to or greater than that of the electron beam aperture 43G.

When a predetermined voltage is applied to the first and second focusing electrodes 30 and 40 having the above structures, equipotential lines are generated in a normal direction of the lines of electric force formed between the first and second focusing electrodes 30 and 40, so that an electron lens is formed. In the electron lens, since the large diameter electron beam apertures 31 and 41 are asymmetrical, vertical focusing components and horizontal focusing components of the electron beams passing through the small diameter electron beam apertures 33G and 43G, and the electron beams passing through the small diameter electron beam apertures 33R and 33B, and 43R and 43B, are different from one another, the electron beams receive different focusing and diverging forces.

That is, since the horizontal distance and the diagonal distance between the central electron beam and the large diameter electron beam aperture 31 is relatively greater than those of the two other electron beams, the central electron beam receives a great diverging force in the horizontal and diagonal directions. Such an operation causes a difference in focus voltage among three electron beams so that a focus feature among three electron beams are deteriorated.

In the electron gun according to a preferred embodiment of the present invention, the vertical diameter of the electron beam aperture 33G of the first focusing electrode 30 is formed to be greater than those of the electron beam apertures 33R and 33B of the first focusing electrode 30, and than those of the electron beam apertures 43R, 43G and 43B of the second focusing electrode 40. Thus, distortion generated due to a difference in focusing and diverging forces in the horizontal and vertical directions of the large diameter electron beam apertures can be reduced.

In particular, since a burring portion is not formed at the edge of the large diameter electron beam aperture 41 of the second outer rim electrode member 42 of the second focusing electrode 40, the effective area of the large diameter electron beam aperture 41 can be increased. Thus, the electron lens formed between the first and second focusing electrodes 30 and 40 can be formed to be great so that spherical aberration affecting the electron beam passing through the electron lens can be reduced. Further, the size of the spot of the electron beam landing on the fluorescent film can be reduced.

Also, since the distance D1 between the end portion of the first outer rim electrode member 32 and the first inner electrode member 33 of the first focusing electrode 30 is formed to be equal to or less than the distance D2 between the end portion of the second outer rim electrode member 42 and the second inner electrode member 43 of the second focusing electrode 40, and no burring potion is formed at the large diameter electron beam aperture 41 of the second focusing electrode 40, the OCV design of the electron gun is easy. Also, since a divergent area of a main lens can be reduced, a focus feature and a convergence feature can be improved.

That is, in the electrodes of the electron gun for a CRT according to the present invention, aberration of the electron beams generated by the large diameter electron beam apertures can be reduced, and the focus feature of the electron beams can be improved by reducing the difference in focus voltage of the three electron beams passing through the large diameter electron beam apertures.

It is noted that the present invention is not limited to the preferred embodiment described above, and it is apparent that variations and modifications by those skilled in the art can be effected within the spirit and scope of the present invention defined in the appended claims.

What is claimed is:

1. In-line electrodes of an electron gun for forming a main lens in a cathode ray tube, said cathode ray tube having a cathode for generating three electron beams, said in-line electrodes comprising:

a first focusing electrode and a second focusing electrode, said first focusing electrode comprising:

a first outer rim electrode having a first large electron beam passing aperture for passing, in common, three electron beams to said second focusing electrode; and a first inner electrode disposed inside said first outer rim electrode, said first inner electrode having three small electron beam passing apertures for passing corresponding ones of said three electron beams to said first large electron beam passing aperture of said first outer rim electrode; and said second focusing electrode comprising:

a second outer rim electrode having a second large electron beam passing aperture for passing, in common, three electron beams received from first large electron beam passing aperture of said first focusing electrode; and a second inner electrode disposed inside said second outer rim electrode, said second inner electrode having three small electron beam passing apertures for passing corresponding ones of said three electron beams received via said second large electron beam passing aperture of said second outer rim electrode, wherein a central one of said three small electron beam passing apertures of said first inner electrode has a diameter larger than a diameter of a central one of said three small electron beam passing apertures of said second inner electrode.

2. The in-line electrodes of the electron gun for forming a main lens as set forth in claim 1, wherein said first large electron beam passing aperture of said first outer rim electrode includes a burring portion and said second large electron beam passing aperture of said second outer rim electrode does not have a burring portion.

3. The in-line electrodes of the electron gun for forming a main lens as set forth in claim 2, wherein said burring portion has a plane portion parallel with a face of said first inner electrode, and a bent portion extending orthogonally from said plane portion towards said face of said first inner electrode, said face of said first inner electrode being disposed to face away from said cathode.

4. The in-line electrodes of the electron gun for forming a main lens as set forth in claim 3, wherein a first distance between a forward most part of said face of said first inner electrode and a forward most part of said first outer rim electrode adjacent said first large electron beam passing aperture is less than a second distance between a rear most part of said second outer rim electrode adjacent said second large electron beam passing aperture and a rear most part of a face of said second inner electrode, said face of said second inner electrode being disposed to face toward said cathode.

5. The in-line electrodes of the electron gun for forming a main lens as set forth in claim 3, wherein a first distance between a forward most part of said face of said first inner electrode and a forward most part of said first outer rim electrode adjacent said first large electron beam passing aperture is equal to a second distance between a rear most part of said second outer rim electrode adjacent said second large electron beam passing aperture and a rear most part of a face of said second inner electrode, said face of said second inner electrode being disposed to face toward said cathode.

6. The in-line electrodes of the electron gun for forming a main lens as set forth in claim 1, wherein the small electron beam passing apertures of said first and second inner electrodes are circular.

7. The in-line electrodes of the electron gun for forming a main lens as set forth in claim 1, wherein the small electron beam passing apertures of said first and second inner electrodes are not circular.

8. The in-line electrodes of the electron gun for forming a main lens as set forth in claim 1, wherein said central electron beam passing apertures of said first inner electrode has a diameter larger than a diameter of the adjacent small electron beam passing apertures of said first inner electrode.

9. The in-line electrodes of the electron gun for forming a main lens as set forth in claim 8, wherein the small electron beam passing apertures of said first and second inner electrodes are circular.

10. The in-line electrodes of the electron gun for forming a main lens as set forth in claim 1, wherein the small electron beam passing apertures of said first and second inner electrodes are oval shaped characterized in that a vertical diameter of said small electron beam passing apertures of said first and second inner electrodes is greater than a horizontal diameter of said small electron beam passing apertures of said first and second inner electrodes.

11. The in-line electrodes of the electron gun for forming a main lens as set forth in claim 8, wherein the small electron beam passing apertures of said first and second inner electrodes are oval shaped characterized in that a vertical diameter of said small electron beam passing apertures of said first and second inner electrodes is greater than a horizontal diameter of said small electron beam passing apertures of said first and second inner electrodes.

12. In-line electrodes of an electron gun for forming a main lens in a cathode ray tube, said cathode ray tube having a cathode for generating three electron beams, said in-line electrodes comprising:

a first focusing electrode and a second focusing electrode, said first focusing electrode comprising:

a first outer rim electrode having a first large electron beam passing aperture for passing, in common, three electron beams to said second focusing electrode; and a first inner electrode disposed inside said first outer rim electrode, said first inner electrode having three small electron beam passing apertures for passing corresponding ones of said three electron beams to said first large electron beam passing aperture of said first outer rim electrode; and said second focusing electrode comprising:

a second outer rim electrode having a second large electron beam passing aperture for passing, in common, three electron beams received from first large electron beam passing aperture of said first focusing electrode; and a second inner electrode disposed inside said second outer rim electrode, said second inner electrode having three small electron beam passing apertures for passing corresponding ones of said three electron beams received via said second large electron beam passing aperture of said second outer rim electrode, wherein a central one of said three small electron beam passing apertures of said first inner electrode has a vertical diameter larger than a vertical diameter of the adjacent small electron beam passing apertures of said first inner electrode and larger than a vertical diameter of a central one of said three small electron beam passing apertures of said second inner electrode.

13. The in-line electrodes of the electron gun for forming a main lens as set forth in claim 12, wherein the small electron beam passing apertures of said first and second inner electrodes are circular.

14. The in-line electrodes of the electron gun for forming a main lens as set forth in claim 12, wherein the small electron beam passing apertures of said first and second inner electrodes have vertically elongated oval shapes.

15. The in-line electrodes of the electron gun for forming a main lens as set forth in claim 12, wherein said first large electron beam passing aperture of said first outer rim electrode includes a burring portion and said second large electron beam passing aperture of said second outer rim electrode does not have a burring portion.

16. The in-line electrodes of the electron gun for forming a main lens as set forth in claim 15, wherein said burring portion has a plane portion parallel with a face of said first inner electrode, and a bent portion extending orthogonally from said plane portion towards said face of said first inner electrode, said face of said first inner electrode being disposed to face away from said cathode.

17. The in-line electrodes of the electron gun for forming a main lens as set forth in claim 16, wherein a first distance between a forward most part of said face of said first inner electrode and a forward most part of said first outer rim electrode adjacent said first large electron beam passing aperture is less than a second distance between a rear most part of said second outer rim electrode adjacent said second large electron beam passing aperture and a rear most part of a face of said second inner electrode, said face of said second inner electrode being disposed to face toward said cathode.

18. The in-line electrodes of the electron gun for forming a main lens as set forth in claim 16, wherein a first distance between a forward most part of said face of said first inner electrode and a forward most part of said first outer rim electrode adjacent said first large electron beam passing aperture is equal to a second distance between a rear most part of said second outer rim electrode adjacent said second large electron beam passing aperture and a rear most part of a face of said second inner electrode, said face of said second inner electrode being disposed to face toward said cathode.

* * * * *